United States Patent [19]

Gibert

[11] Patent Number: 5,026,040

[45] Date of Patent: Jun. 25, 1991

[54] DEVICE FOR THE SEQUENTIAL INTRODUCTION OF SHEETS IN A SHAPING OR FORMING MACHINE

[75] Inventor: Henri Gibert, Calluire et Cuire, France

[73] Assignee: SA Martin, France

[21] Appl. No.: 513,810

[22] Filed: Apr. 24, 1990

[30] Foreign Application Priority Data

Apr. 27, 1989 [FR] France ..... 89 05947

[51] Int. Cl.[5] ..... B65H 3/04

[52] U.S. Cl. ..... 271/35; 271/99; 271/108; 271/112; 271/115; 271/117; 271/119; 271/132

[58] Field of Search ..... 271/34, 35, 99, 105, 271/108, 109, 112, 115, 117, 118, 119, 132

[56] References Cited

U.S. PATENT DOCUMENTS

| | | | |
|---|---|---|---|
| 3,193,282 | 7/1965 | Stewart | 271/35 X |
| 3,754,752 | 8/1973 | Thayer | 271/132 |
| 3,904,190 | 9/1975 | Kuehn | 271/99 |
| 3,941,372 | 3/1976 | Matsuo | 271/99 X |
| 4,168,829 | 9/1979 | Wilson et al. | 271/99 X |
| 4,181,298 | 1/1980 | Capdeboscq | 271/35 X |
| 4,236,708 | 12/1980 | Matsuo | 271/99 X |
| 4,494,745 | 1/1985 | Ward, Sr. et al. | 271/99 X |
| 4,614,335 | 9/1986 | Sardella | 271/112 |
| 4,681,311 | 7/1987 | Sardella | 271/11 |
| 4,828,244 | 5/1989 | Sardella | 271/35 X |
| 4,889,331 | 12/1989 | Sardella | 271/105 X |
| 4,896,872 | 1/1990 | Sardella | 271/35 X |

FOREIGN PATENT DOCUMENTS

| | | |
|---|---|---|
| 0183361 | 6/1986 | European Pat. Off. . |
| 2518073 | 6/1982 | France . |

*Primary Examiner*—H. Grant Skaggs
*Assistant Examiner*—Druzbick
*Attorney, Agent, or Firm*—Hill, Van Santen, Steadman & Simpson

[57] ABSTRACT

A device for sequentially introducing sheets placed in a stack into the nips of a pair of introduction rollers comprising at least one linear member having ends secured to a control pulley or roller and passing around a return pulley or roller which is adjacent the nips of the introduction rollers. A plurality of cams mounted on rotating shafts for engaging a run of the linear member to shift it from a retracted position to a position for engaging a bottom sheet in a stack disposed above the linear member, a vacuum chamber disposed along each linear member for holding the sheet on the members as they engage the sheet and carry it toward the nips.

14 Claims, 9 Drawing Sheets

DEVICE FOR THE SEQUENTIAL INTRODUCTION OF SHEETS IN A SHAPING OR FORMING MACHINE

BACKGROUND OF THE INVENTION

The present invention is directed to a device for the sequential introduction of plates or sheets into a shaping or forming machine when these sheets are to be introduced one-by-one in succession taken from a bottom of a pile located in a magazine.

Feeding and forming machines include, for example, either printing and grooving machines, or a cut-out machine meant for shaping or forming a sheet made of corrugated cardboard for the preparation of packaging material, which cut-out machine generally comprises tools for printing, for cutting out, and for locally creasing the cardboard so as to form lines for the later folding of the cardboard. In the feeding station for such shaping and forming machines, the plates or sheets contained in a magazine are introduced in succession and in phase with the rotation of the printing and/or cut-out tools.

The precision of the introduction of each plate or sheet into the machine at the suitable time of the cycle enables the correct position for the operations to be performed on the plate, for example the dimension precision of the finished packaging box, as well as the precision and registration of the markings or printings that are to be made on the box blank. That precision is even more important when the cut-out an printed rough packing box must then pass through automatic folding stations, which are now generally the case.

French Patent No. 82 09687 discloses one example of an introduction device used in the usual machine. The introduction device includes means to move along, in a synchronized manner, sheets of corrugated cardboard, which means includes endless belts that rotate intermittently in a single direction and are brought against a lower sheet of a pile by a lifting member that works against an upper run of each of the endless belts. The forward motion of the endless belts and the lifting members are actuated in a manner so that the sheet will be moved along in synchronism with a machine for the subsequent treatment of the sheet. To maintain the sheet against the belts, a continuous vacuum is used. This makes it possible to prevent a sliding that normally is associated with the use of belts rotating in a continuous manner with the application of an intermittent suction pressure. The device, furthermore, is associated with a mechanism that makes it possible to stop, one time out of two, the moving of the sheets.

Another device for the introduction of sheets is described in U.S. Pat. No. 4,614,335. This device relates to a feeding attachment in which there is used a series of small discs or rollers placed into rotation, always in the same direction, and means which will accelerate and retard the speed of rotation of the small discs or rollers. These small rollers are mounted in an upper closing plate of a vacuum chamber that is vertically movable under the action of a cam and lever arrangement. Thus, the departure of the sheet is insured by removing the lower sheet of a pile from the driving small discs or rollers by a raising motion of the vacuum chamber. The same device, in a special form of execution, is described in U.S. Pat. No. 4,681,311, which is a continuation of the first-mentioned U.S. Patent and includes feeding rollers or belts that introduce the sheet between the introduction rollers without any sliding.

A third device that constitutes a variation of the above-mentioned processes and devices is described in detail in European Patent Application published under number 01 83 361. This third device has introducing members which are formed by small discs or rollers coated with a material having a high friction coefficient and which rollers cooperate with a member that lifts the pile of sheets. The small discs or rollers are placed in an enclosure formed by a vacuum chamber. The small discs or rollers are governed in a manner such that they can be driven in two directions of rotation so as to free the pile of sheets from the front gate member, which is arranged so that only one sheet passes at a time between the lower edge of the gate member and a surface, which is defined by the plane of the introduction table and constitutes one of the upper walls of the vacuum chamber.

The above-described three devices have a major drawback with respect to replacement of the introduction members in contact with the sheet to be introduced. Indeed these members are subjected to great wear and require frequent replacement. The replacement causes an important down-time for the machine because the introduction members are arranged in such a manner that a complete disassembly of the introduction station often is necessary in order to make the necessary replacements and repairs. Besides, in all of the devices that make use of small discs or rollers as introduction members, it is necessary to change some of them more frequently, because of the uneven wear that may be present because of their relative position to the various formats of the sheets being handled. Other drawbacks, and not among the least ones, results from the fact that the suction chamber is a single chamber and acts over the entire plane defined by the lower sheet of the pile. Thus, during the work with different size sheet formats, there occurs losses of vacuum that may bear a negative influence on the good functioning of the device.

A drawback particular to the first device of the above-mentioned devices is the fact that the members for the lifting of the endless belt is formed by an articulated shoe which has a vertical movement that alternates from the bottom up and from the top down. The endless belts move linearly in a direction toward the front gate to insure the introduction of the sheet, and of necessity a friction will occur between the upper run and the support surface of the lifting member during the introduction of a sheet. With time, this friction causes the wearing out of an internal face of the belt, which will be subjected to wear stresses on its external faces in contact with the sheet, as well as on the internal face meant to insure the adhesion of the endless belt around the driving and return pulleys. This arrangement, of course, will have an important effect on the life span of the endless belt and will require, therefore, frequent replacement of the introducing members which, as mentioned above, causes an immobilizing of the machine over a period of time corresponding to the time necessary for the disassembly of the introduction station. The time for the replacement of the introduction member being important, there will follow, of course, an important decrease in the total efficiency of the machine.

SUMMARY OF THE INVENTION

The present invention has, as its purpose, to bring a simple and rational solution to offset the above-mentioned drawbacks and to supply the user with a means especially adapted to work the introduction of sheets or plates of corrugated cardboard into a shaping or forming machine.

To accomplish these goals, the present invention is directed to an improvement in a device for the introduction of plates or sheets into a shaping or forming machine from a pile of plates located in a magazine found below a feeding table that has a front portion, a front gate for holding back the stack of sheets, which gate is located upstream from two introducing rollers, the device includes a vacuum chamber and sequential transportation means placed side-by-side and being vertically movable, and means to drive said means for sequential transportation linearly and vertically. The improvements are that the sequential transportation means are formed by at least one linear member that passes around a return pulley located close to the front gate and to the introduction rolls and around a drive pulley and has the two ends fixed to the drive pulley which will impart a rotating motion alternately in one direction and then the other. An upper run of the linear member that extends between the two pulleys is supported by means for elevating the upper run into engagement with a bottom sheet in the stack, which means includes a plurality of small discs, which are either eccentrically mounted on shafts or have an eccentric shape so that rotation of the shaft causes the periphery of the disc to move the linear member up and down. The shafts are mounted in two lateral plates which, in turn, can be vertically displaced. The linear member is put under tension between the return pulley and the drive pulley and the drive pulley is connected by a transmission arrangement to a drive source so that the drive pulley is placed in a pendular or reciprocating motion on its shaft, which is produced by a connecting rod crankshaft assembly that interconnects a shaft of the drive pulley to the source of rotation, said sequential transportation means also including a gear train that transmits the continuous rotational motion of the crankshaft to the shafts of each of the small discs and is timed with the drive of the linear member so that the forward motion of the linear member occurs as it is being lifted by the small disc or roller of the lifting arrangement.

According to the preferred embodiments of the present invention, the linear member is a rubberized belt having the free ends which are secured on the drive pulley that imparts in alternate rotary motion.

According to another characteristic of the present invention, a vacuum chamber is advantageously formed of chambers or boxes placed on each side of each linear member with the boxes or chambers being connected to a common source of vacuum from which they can be separately insulated by closing means which are formed as drawer-type shutters.

One of the advantages obtained by the present invention essentially is found in that the replacement of the introduction members can be done without a tedious disassembly of the introduction station so that the down-time for the machine is greatly reduced. Another advantage obtained with the device according to the present invention is that because of the shape an continuous rotating motion of the belt lifting members, these no longer are subjected to an ill-timed wear of the internal contact face at the time of the introduction operation.

Other advantages and features of the invention will be readily apparent from the following description of the preferred embodiments, the drawings and claims.

DESCRIPTION OF THE PREFERRED EMBODIMENTS

Figure 4:
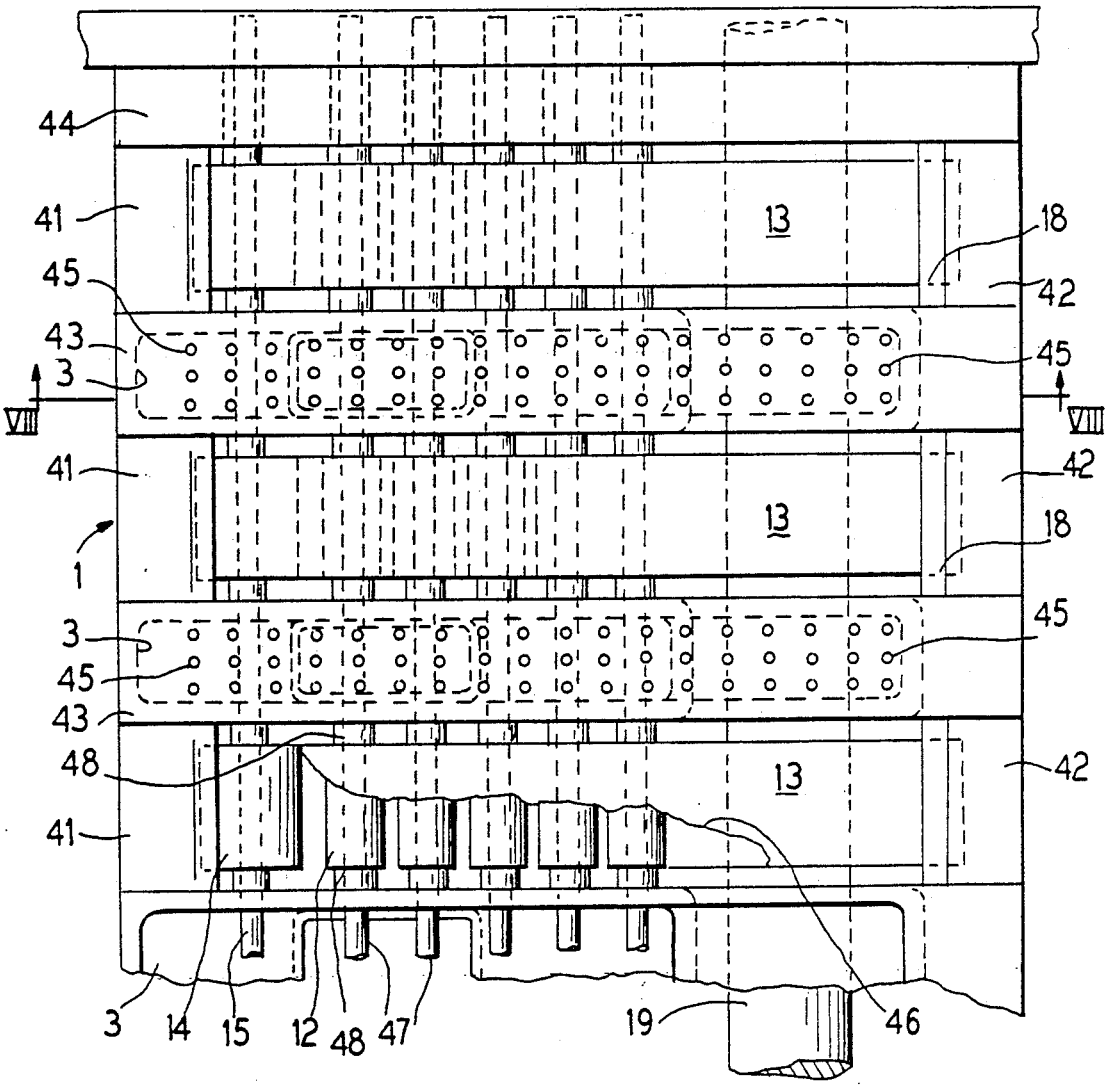
FIG. 4 is a partial plan view of the device of FIG. 1 with portions broken away for purposes of illustration.

The principles of the present invention are particularly useful when incorporated in a device, generally indicated at 1, for introducing plates or sheets. As illustrated, the device 1 includes a vacuum chamber 2 formed of separate chambers or boxes 3, which are placed on each side of linear introduction members 4, as best illustrated in FIGS. 4 and 5.

Figure 1:
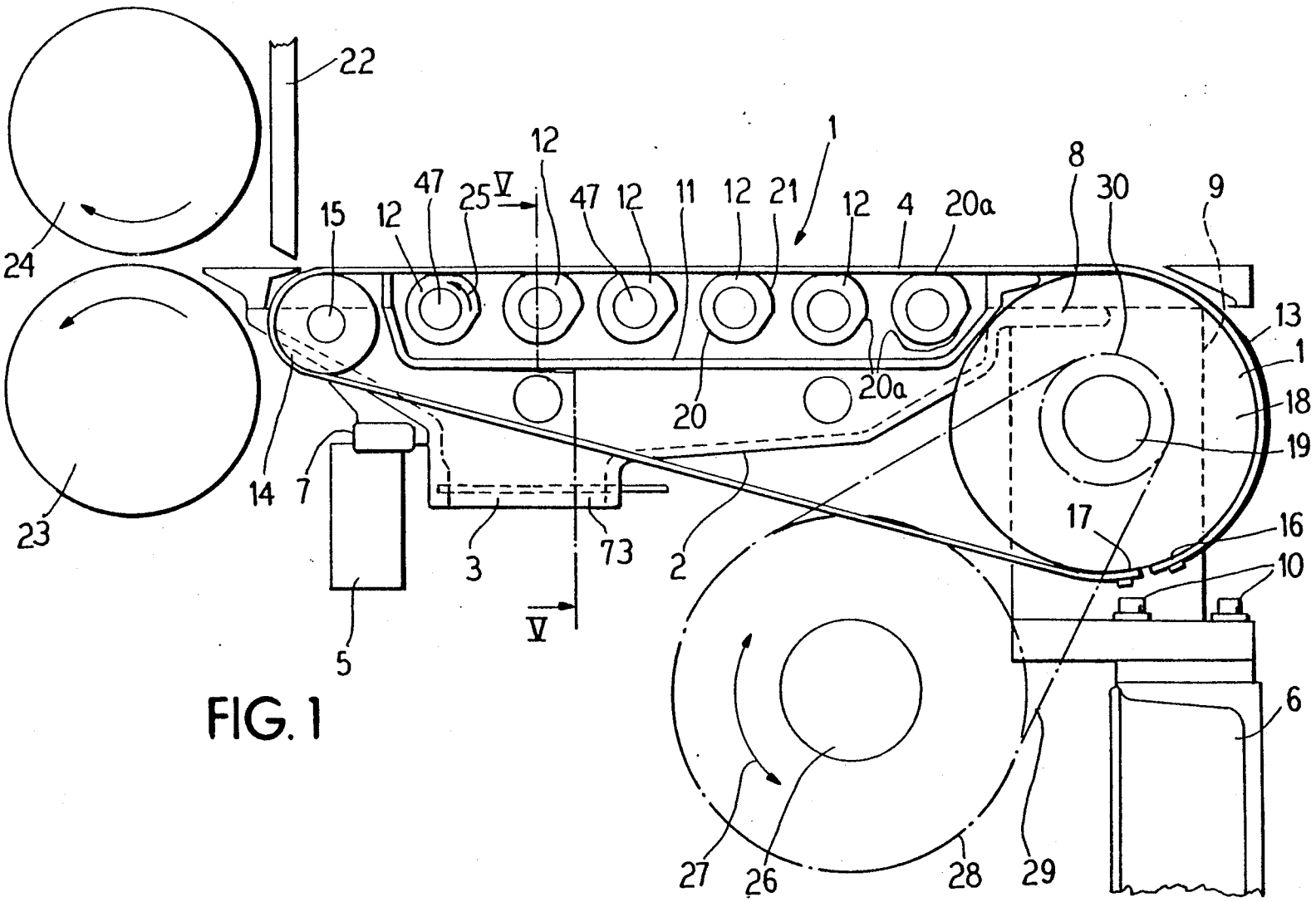
FIG. 1 is a schematic side view with portions partially in section of the introduction station in accordance with the present invention.

The vacuum chamber 2 is supported by small beams 5 and 6 (FIG. 1). A sole 7, which is located on a front end of the chamber 2, is fixed by means of screws that are not shown on the small beam 5 while a fixation tab 8 located on a rear of the chamber 2, for its part, is screwed against a support 9 that, in turn, is fixed by screws 10 to an upper face of the cross beam 6.

Figure 5:
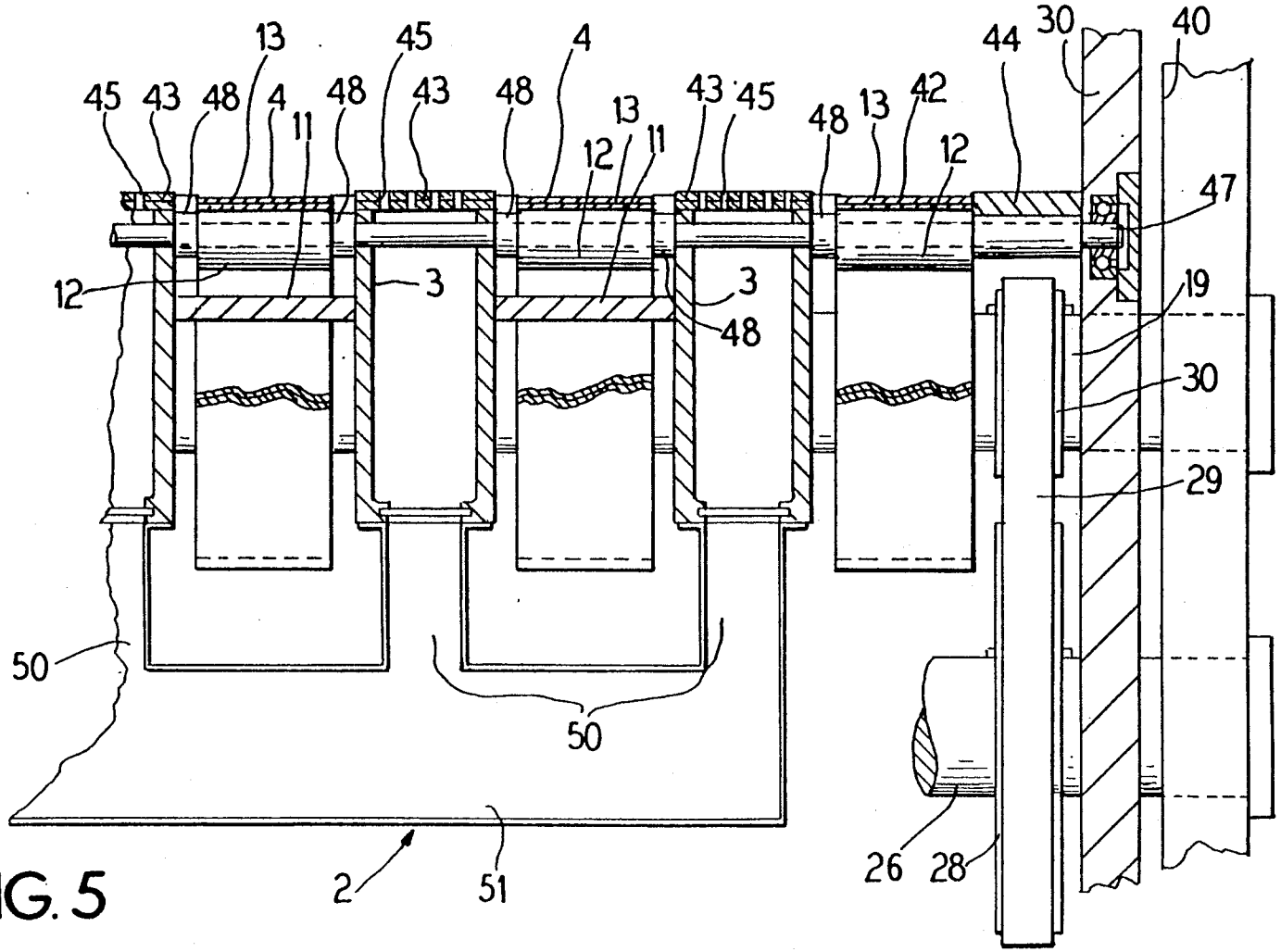
FIG. 5 is a partial cross sectional view taken along the line V—V of FIG. 1.

As illustrated in FIGS. 1 and 5, underneath each of the linear introduction members 4, the boxes or compartments 3 of the vacuum chamber 2 are interconnected by a wall 11, which mechanically binds the small chambers 3 together and also leaves a free space for small discs or rollers 12 of the means for shifting the linear introduction member 4 in a vertical direction. The small discs or rollers 12 have a non-circular periphery and could, advantageously, be formed as cams. The linear introduction member 4 comprises a linear member 13 that may be a rubberized belt or a covered band that passes around a return roller 14 mounted so that it can be rotated freely on a transverse shaft 15. Ends 16 and 17 of the member 13 are fixed to a drive pulley 18, which is keyed by a cotter pin to a driven shaft 19. The diameter of the drive pulley 18 is chosen so that at least one sector of the linear member 13 will always be in contact with the drive pulley 18 during both an "active" and "non-active" rotation of the same.

An upper run of the linear member 13 passes above the series of small discs or rollers 12 which are mounted on shafts 47 which can be rotated continuously in the direction indicated by the arrow 25. The shape of the small discs 12 with the discontinuous circumference is defined by two circle portions 20 and 21, the radius of the circle portion 20 being less than the radius of the circle portion 21 and the connection between the two circle portions 20 and 21 being done by tangents 20*a* to the circle 20 that form therebetween an angle of approximately 60°. The radius of the circle portion 20 is chosen so that when the small disc or roller 12 occupies the position shown in FIG. 1, there is no contact between a linear part and the internal face of the linear member 13. The radius of the circle portion 21 is chosen, for its part, in a manner such that it can lift the upper run of the linear member 13 during rotation of the small disc or roller 12 in the direction indicated by the arrow 25.

The lifting of the linear member 13 will put an upper surface of this member in contact with the lower sheet of a pile (not shown). The drive pulley 18 is driven in a manner such that the beginning of its "active" rotation takes place after the circular portion 21 of the small disc or roller 12 have come in contact with the internal face of the upper run of the linear member 13, that is to say after the member 13 has contacted the lower sheet of the stack. Thus, by the combined effect of the linear displacement in the "active" run of the member 13 and of the lifting of the same by the small discs or rollers 12 and the suction supplied by the vacuum chambers 3, the introduction of a sheet under a forward or front gate 22 can take place to insert the front end of the sheet between the nips of the introduction rollers 23 and 24, which are driven at a linear speed that is approximately equal to or slightly greater than the linear speed of the member 13.

It is obvious that when the "active" run of the introduction member 13 is over, the kinematics chosen to drive the small discs or rollers 12 will cause the latter to present themselves facing the internal face of the upper run of the introduction member 13 so that the circle portions 20 having the small diameters such that the upper run will come to place itself somewhat below the plane defined by the upper part of the vacuum chambers will, thus, permit the remaining "active" run as well as the "non-active" return run of the member 13, without there being any friction between the member and the sheets to be introduced.

In the example illustrated in FIG. 1 the movement transmitted to the first shaft 19 comes from a governing or control shaft 26 that is imparted with a rotating back and forth movement, indicated by the double-arrow 27. The transmission of that motion is done by means of a toothed wheel or gear 28 mounted on the control or drive shaft 26 and connected through a chain or notched belt 29 to a toothed pinion 30 mounted on the shaft 19. In this Figure, this transmission member has been represented in dash-dot lines and the ratios that exists between the toothed wheel 28, and the toothed pinion 30, the diameter of the pinion 30 and the drive or control pulley 18, and the drive for the rotation of the small discs or rollers 12 and the angular displacement of the drive or second shaft 26, are chosen so that the linear displacement of the member 13 will approximately correspond to the forward motion necessary to introduce a sheet from a starting position with the forward edge in contact with the gate 22 to a position with the forward edge between the nips of the introduction rollers 23 and 24.

Figure 3:
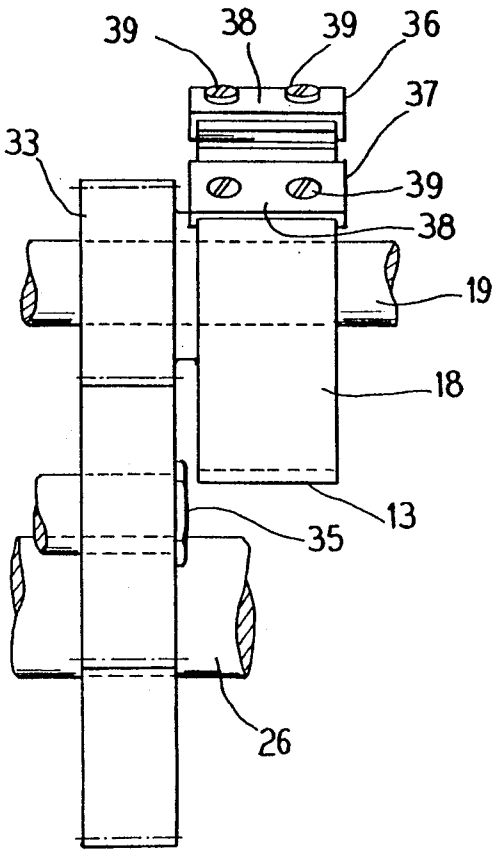
FIG. 3 is an end view taken from a direction indicated by arrow A of FIG. 2.
Figure 2:
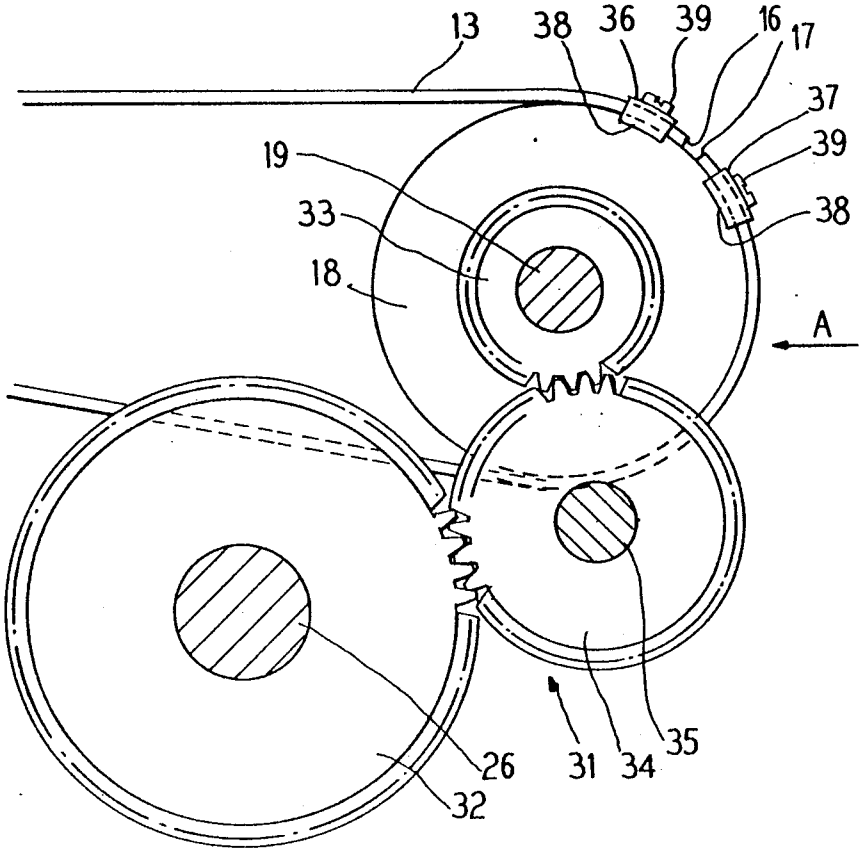
FIG. 2 is a schematic side view of the drive means for the introduction device of FIG. 1.

FIG. 2 schematically shows a second arrangement or modification for the transmission motion from the control or second shaft 26 to the drive or first shaft 19. In this embodiment, the toothed pinions and notched belts 28, 30 and 29, respectively, are replaced with a gear train 31 that has a toothed wheel 32 mounted on the second shaft 26 and connected to a toothed pinion 33 affixed to the first shaft 19 by means of an intermediary toothed wheel or gear 34 mounted so that it could be freely rotated on an axle 35. As it can be seen in FIG. 2, the linear member 13 is represented in the position that it occupies at the end of its "active" run, that is to say when the fixation elements 36 and 37 of the ends 16 and 17 of the member 13 are in their upper position. Thus, the rear sector of the drive pulley 18 has always remained in contact with an internal face of the introduction member 13 during its "active" rotation and will still remain in contact with the same during the "non-active" return rotation. As shown in both FIGS. 2 and 3, the fixation elements 36 and 37, advantageously, consist of a rider 38 that extends over the control pulley or driven pulley 18 and that pinches the ends 16 and 17 of the introduction member 13 under the action of a tightening of screws 39.

FIG. 4 is a partial plan view of FIG. 1 which represents, in a schematic manner, the right-side part of the introduction station that comprises between two lateral frames of which only the right side is represented in a device for the sequential introduction of the plate or sheet 1. For the sake of clarity of the drawing, it has been chosen to omit the representation in the Figure of the holdback gate or member 22 and of the introducing rollers 23 and 24.

Figure 6:
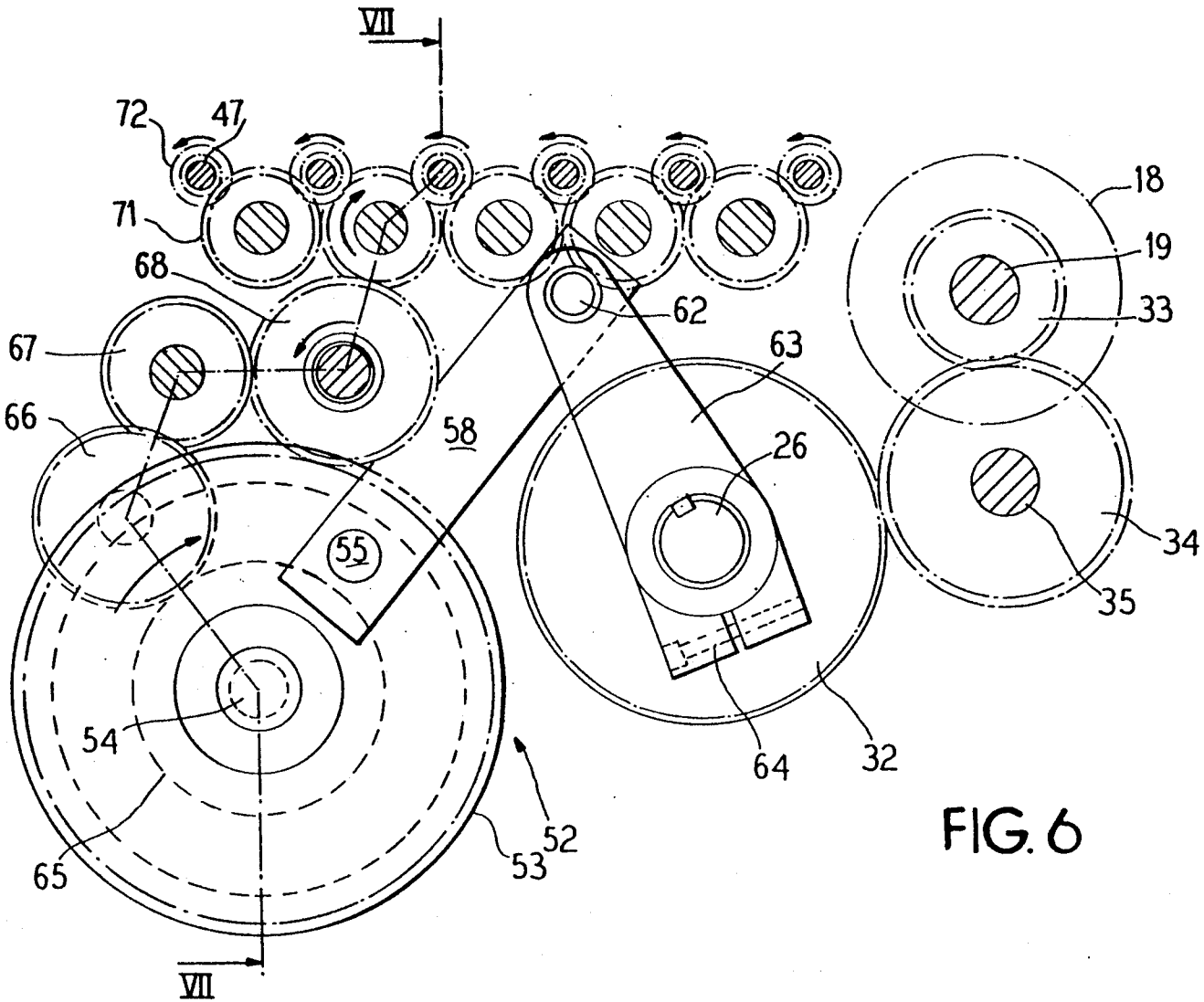
FIG. 6 is a schematic view of a kinematic chain of the device for the sequential introduction.

As it is noted, the device 1 for the sequential introduction comprises a flat surface made up of plates 41–44 to cover the zone located above the chambers or boxes 3, as well as the zones located at the front end and at the rear end of each of the linear introduction members 13. The plates 41 cover the zone located at the front end, while the plates 42 cover the zone at the rear end of the members 13 and are simple, smooth plates, as is the plate 44, which is located close to the lateral frame 40. The plates 43 that cover the zones located directly above each of the chambers or boxes 3 are, for their part, pierced with a multiplicity of openings 45 to permit a vacuum to act on the lower sheet to be introduced into the machine. A portion of one of the belts forming the introduction members 13 is broken away along a line 46 to show the manner in which the small rollers 12 are mounted on their respective shafts 47 So that a vacuum will be confined in each of the chambers or boxes 3 and in order to isolate the chambers or boxes from the zone in which the introduction member 13 is located, tightness sockets or sealing sleeves 48 are provided on each side of the small discs or rollers 12. The same solution has been used to insure tightness between the chambers or boxes 3 and the return and control pulleys 14 and 18, respectively. The arrangement of the drive members of the various shafts shown in the Figure will be described below with reference to FIGS. 6 and 7.

As illustrated in FIG. 5, each of the boxes or chambers 3 of the vacuum chamber 2 are connected together at their lower part by a duct 50 that opens into a manifold 51 that is connected to a source of vacuum that may be, for example, a turbine-type vacuum pump (not shown). FIG. 5 also shows the relative position of the plates 43 and 44 with respect to the upper surface of the members 13. As may be seen in this Figure, the members 13 are supported by the small rollers 12 and are located approximately below the plane defined by the upper faces of the plates 43 and 44 when the protruding part or high point of each of the rollers is not in contact with the upper run of the member 13. During the rotation of the shaft 47, the protruding or high part of each of the small rollers will move to a position to lift the introduction member 13 above the level of the plates 43 and 44, so that when the members are set into motion they will cause the introduction of the lower or bottom sheet of the pile of sheets to be worked with.

A kinematic chain or transmission for driving the members of the sequential introduction device 1 are illustrated in FIG. 1. The main motion comes from a driven shaft (not shown) of the shaping or forming machine, and it is communicated to a connecting rod-crankshaft assembly 52, which is formed by a toothed wheel or gear 53 supported on a third shaft 54. A handle or pin 55 is arranged against one of the faces of the gear 53 and is pivotably connected to one end of a link 58. The link 58, at the opposite end, has a pin or spindle 62 on which is pivotably connected an end of a lever 63, which is clamped to the control or second shaft 26 by a tightening device 64 and is keyed to this shaft by a key so that movement of the lever 63 will rotate the shaft 26 and the gear 32 to transmit the motion of the shaft through the gear 34, the pinion 33, to the first shaft 19 to oscillate the control pulley 18. The use of the lever 63 and link 58 forms means for rotating the control shaft 26 back and forth through a precise angle or amount. This can be replaced, for example, by a control device with cams and levers.

The third shaft 54 also supports a gear 65 that engages with a pinion 66 connected to another gear 67 that can rotate a gear 68 mounted so as to be axially movable on a shaft 69 (FIG. 7) by means of a fork 70. A double-width pinion 71 serves as an intermediate gear to drive into rotation each one of the pinions 72, which are connected to the shafts for the small rollers 12. The assembly that has just been described, in fact, constitutes a gear box or transmission having a ratio 1:1 when the gear 68 is in meshing relationship with a gear 67 and a ratio 1:2 when the gear 68 is shifted to be out of meshing relationship with the gear 67 and in meshing relationship with the gear 53. When the pinion 68 engages with the gear 53, this will bring about a high speed of rotation of the shafts 47, thus forcing the small rollers to rotate at a speed higher than when the gear 68 is meshed with the gear 67. The ratio 1:2 for the rotation of the shafts 47 and the small rollers 12, thereby, makes possible, indifferently, more than one lifting of the member 13 in the course of a single "active" run of the latter. This makes it possible, in the case of treatment of large size sheets, to introduce one sheet with two forward motions of the introduction member 13. It happens that it is desired to stop the introduction of the sheet into the machine for the ease of regulating and/or adjusting, for example, its position. It is also possible to provide a stop in the action of the small discs or rollers. This could be conceived by the arrangement illustrated in FIG. 9, wherein the shafts 47 and the control means are mounted in a wall 90 which can be shifted to a lower position to remove the rollers 12 from contact with the upper run of each of the members 13.

Figure 7:
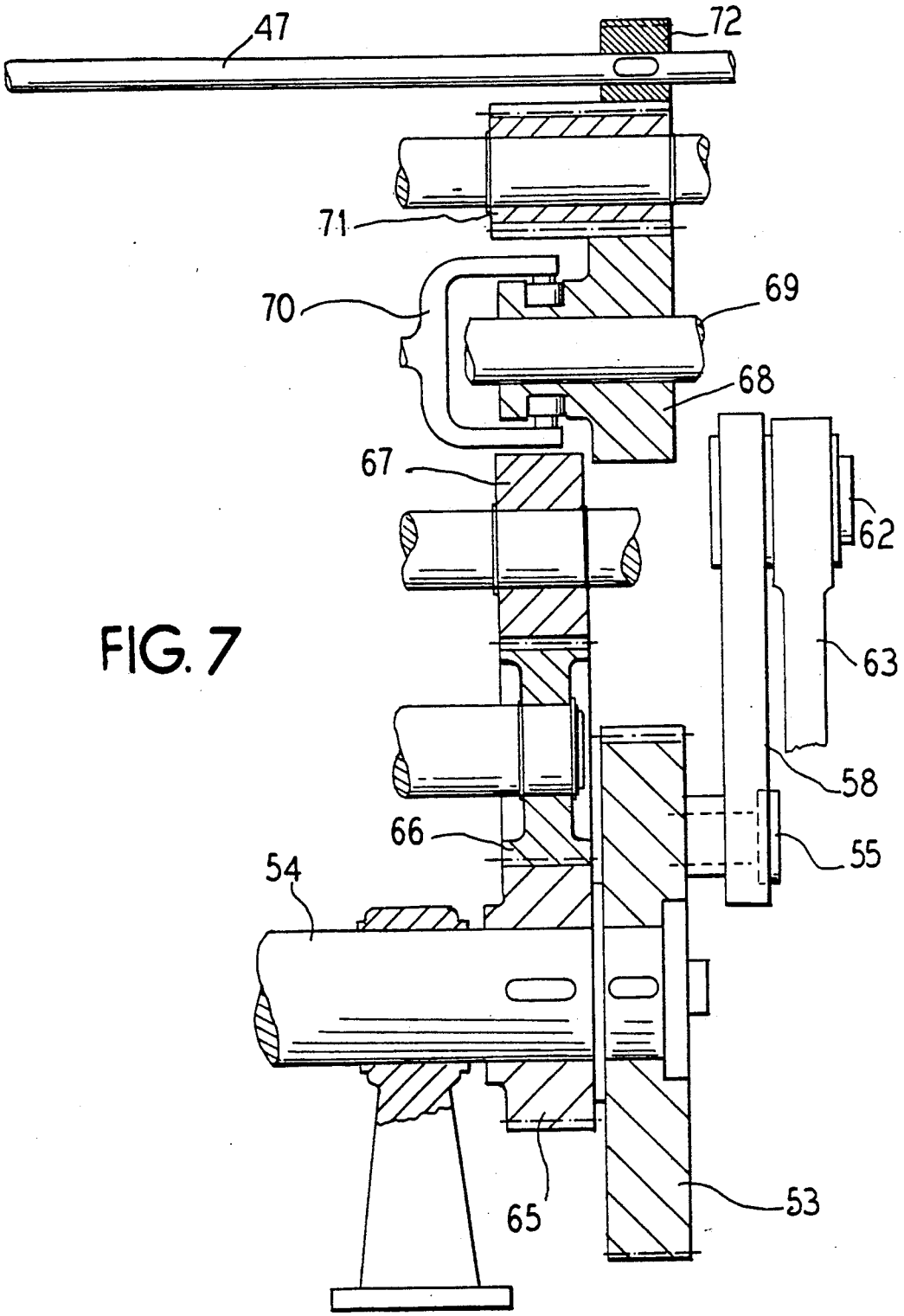
FIG. 7 is a partial cross sectional view taken along the lines VII—VII of FIG. 6.

As illustrated in FIG. 7, the fork 70 and the gear 68 have been shifted on the shaft 69 from a position in meshing engagement with the gear 67 to a position for engagement in the gear 53. However, this meshing engagement between the gears 68 and 53 is not illustrated in FIG. 7, due to the particular arrangement of the cross section.

Figure 8:
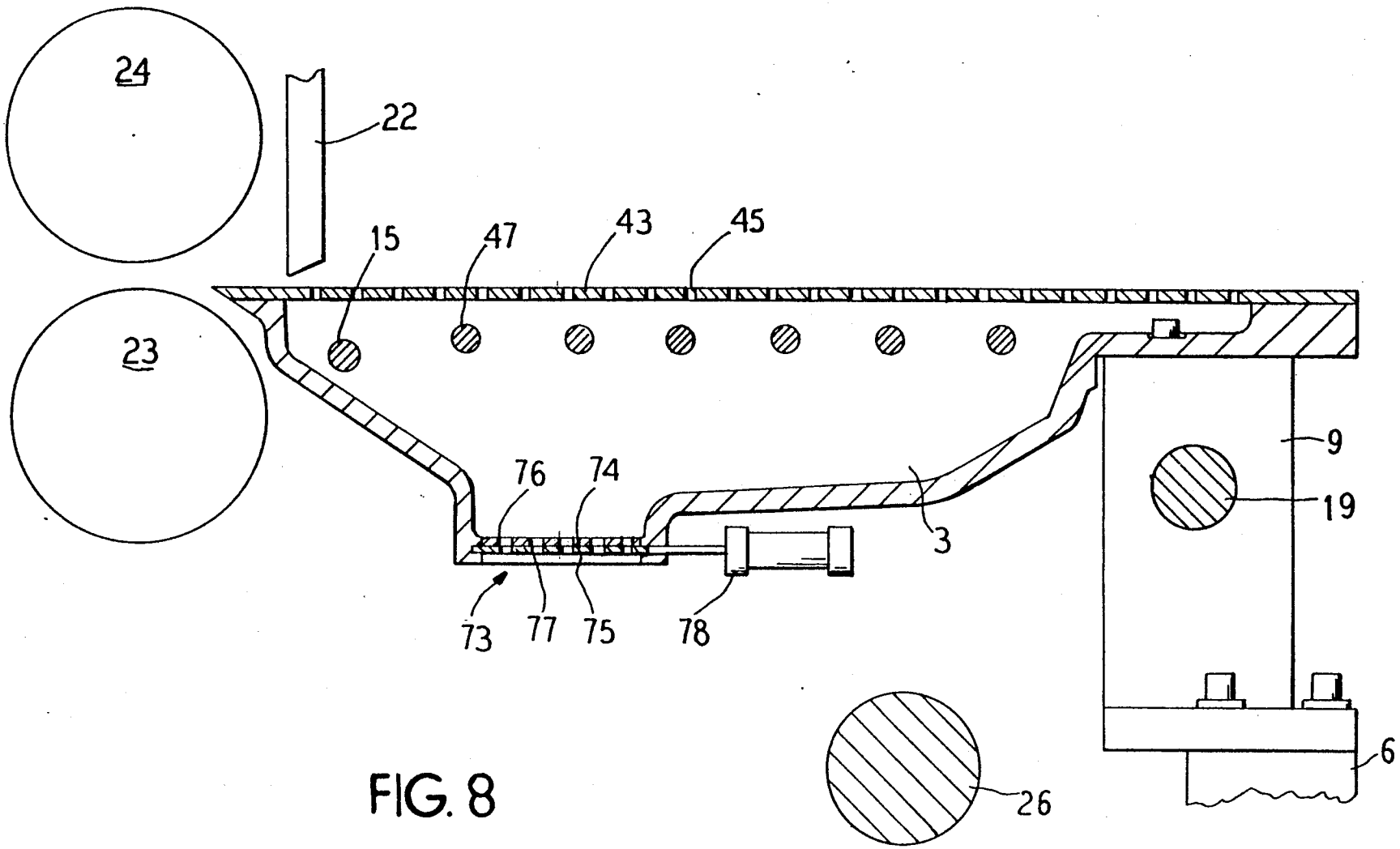
FIG. 8 is a cross sectional view taken on lines VIII—VIII of FIG. 4.

As illustrated in FIG. 8, each of the boxes or chambers 3 is equipped in its lower part with a closing device 73 that comprises a fixed grid 74 and a movable or sliding grid 75. The fixed grid 74 is provided with openings 76 and the movable or sliding grid 75 has openings 77. In a preferred form of execution, the movable slide 75 is connected to a pneumatic cylinder 78 that, when it is operated, is going to open or close the opening 76 of the fixed grid 74, thus making it possible to use only the desired chambers or boxes that are located in the area represented by the shape of the sheet to be introduced. Thus, when the size of the sheet changes, the operator of the device can selectively isolate certain of the boxes to prevent a loss of vacuum from the boxes which are not covered by the sheet.

Figure 9:
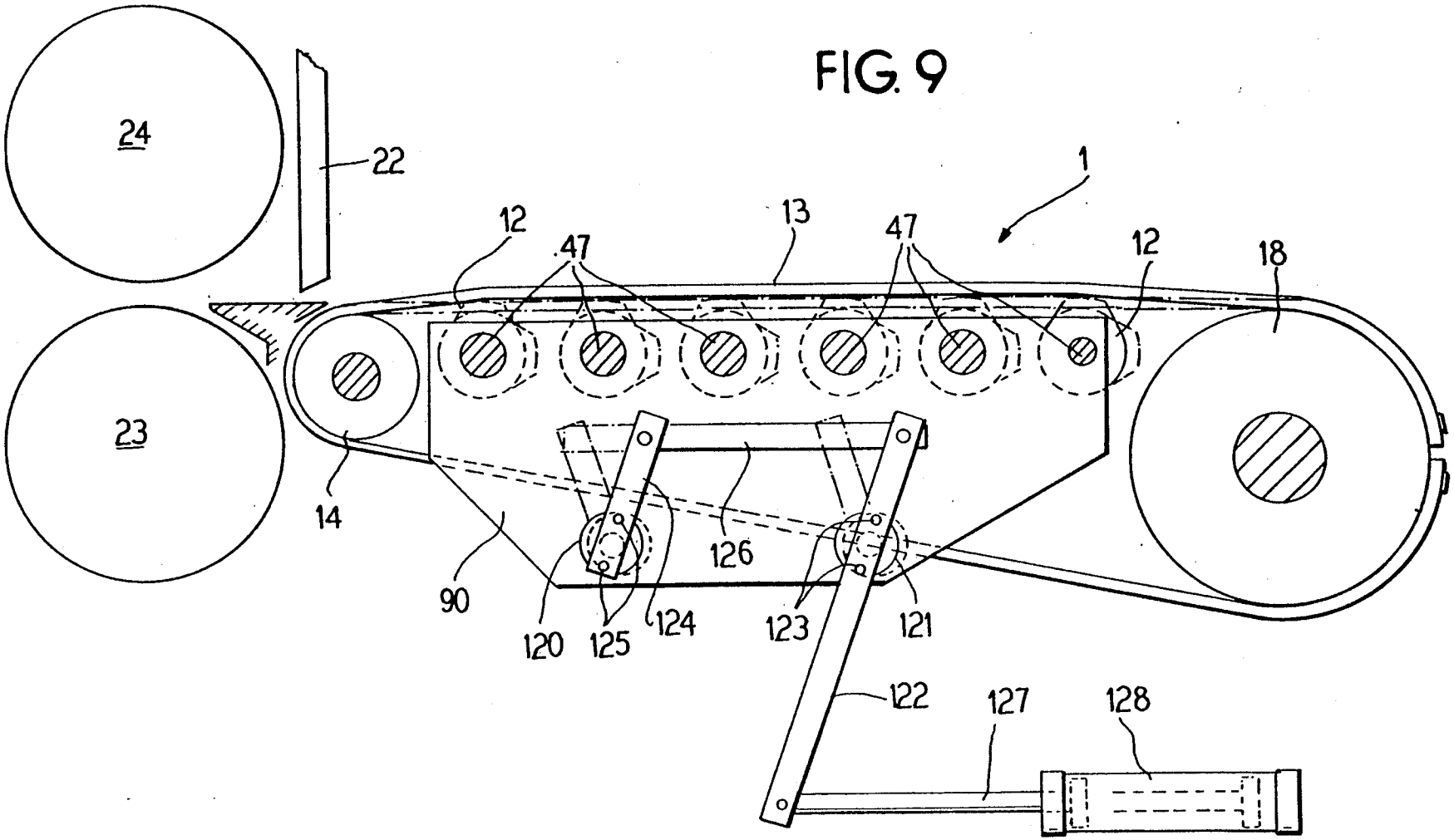
FIG. 9 is a side view of the lateral plates that support the shafts of the small discs or rollers having the eccentric and non-circular circumferences.

As mentioned hereinabove, FIG. 9 shows an arrangement wherein lateral plates 90 support the shafts 47 for the small rollers 12. As was indicated above, it is desirable to be able to intermittently move the advancing of the members or belts 13 in and out of engagement with the sheet being transferred. To this end, it is judicious to stop the action of the small rollers 12 on the linear member 13 by displacing them downward in a vertical direction. This operation is made possible with the help of two eccentric shafts or spindles 120 and 121 which are mounted for rotation in each one of the lateral plates 90. The ends of the eccentric spindle 121 is equipped with a lever 122 which is held by screws 123. The end of the eccentric spindle 120 is equipped with a lever 124 which is fixed by means of screws 125. One of the ends of the lever 122 is connected to the end of lever 124 by means of a connecting rod or link 126. The other end of the lever 122 is connected to a rod 127 of a pneumatic piston 128. The position represented in FIG. 9 in bold lines hows the sequential introduction of the device 1 in operation, that is to say when the lateral plates 90 occupy a "high" position. The out-of-service position is shown in dash-dot lines in that Figure.

In the present embodiment, it is necessary to provide for a pneumatic cylinder 128, levers 122 and 124, a connecting rod 126 and eccentric spindles 120 and 121 assembled on each side of the lateral plate. A simplification could be achieved using eccentric spindles 120 and 121 which extend between the two plates, would make it possible to use only one piston and lever assembly.

Figure 10:
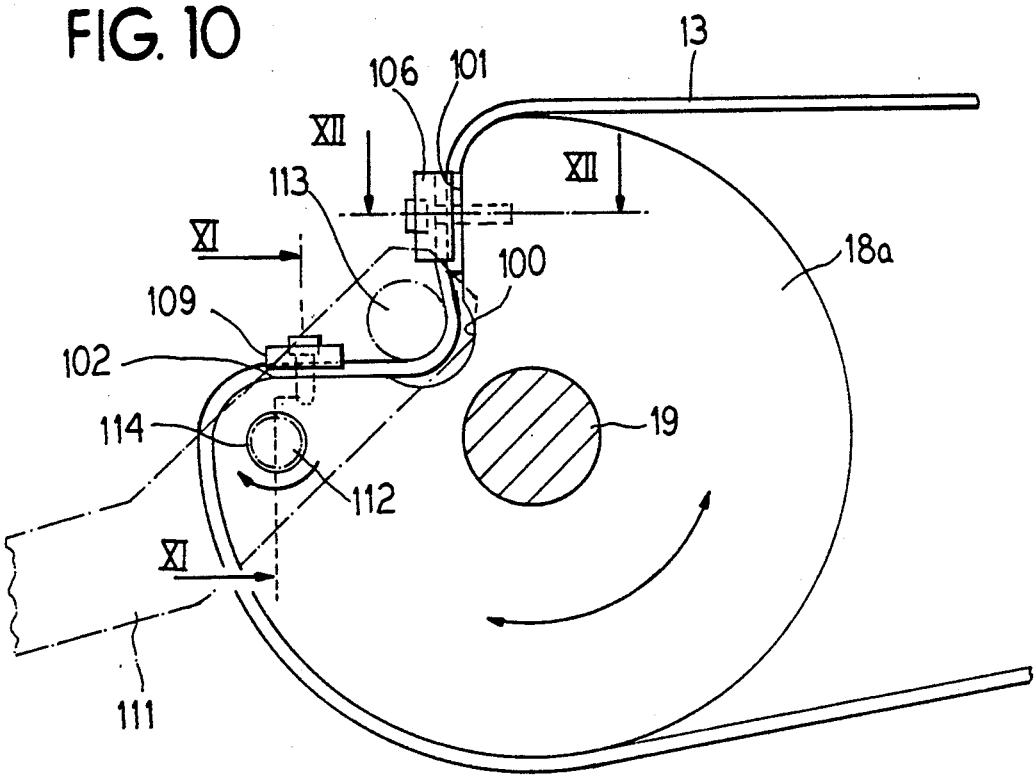
FIG. 10 is a side view of the means for fixation of the linear member on the drive pulley.
Figure 11:
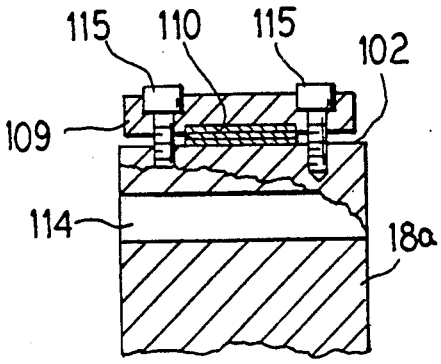
FIG. 11 is a cross sectional view taken along the lines XI—XI of FIG. 10.
Figure 12:
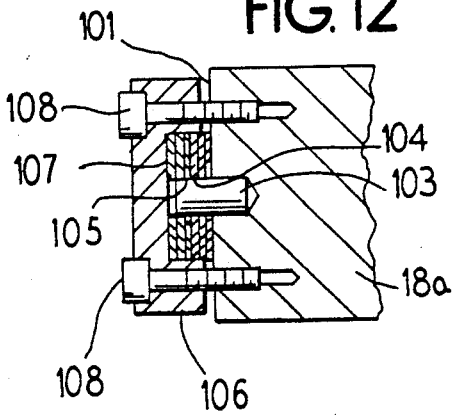
FIG. 12 is a cross sectional view taken along the lines XII—XII of FIG. 10.

A desired way of fixing the linear member 13 on a control or drive pulley **18*a* is illustrated in FIG. 10. In the form represented, the control pulley 18*a* has a hollowed out area 100 that comprises a first face 101 and a second face 102. The face 101 is equipped with a cylindrical pin or projection 103 (see FIG. 12). While the cylindrical pin is shown as being set in a bore in the face 101, it could, of course, be screwed into a threaded bore. The linear member 13, at each end, has an eye or opening 104, 105, respectively, that is engaged on the pin or projection 103 so that the two ends of the linear member 13 will be superimposed at that point. A first tightening flange or clamp 106, which has side flanges 107 of a thickness that is appreciably less than the thickness represented by the two superimposed ends of the linear member 13, will hold the two ends against the face 101 by means of screws 108. A second tightening flange or clamp 109 (FIG. 11**) holds the linear member 13 against the face 102 of the hollowed-out area 100. The tightening flange 109 has side flanges 110 with a thickness that is appreciably less than the thickness of the member 13, as illustrated.

The linear member 13, thus, is rigidly connected to the control pulley 18*a* by the pin 103 and flange 106. It is then necessary to give the member 13 a certain tension in order for it to work correctly. To this end, there is provided the use of a lever 111, shown in dot-dash lines in FIG. 10. The lever 111 comprises two cylindrical pins or tendons 112 and 113. The pin 112 is engaged in a bore 114, which is provided in the control pulley 18*a*, while the pin 113 is put into contact with the linear member 13. Thus, after the linear member 13 has been secured on the pulley 18*a* by the flange 106, it will be easy, by actuating the lever 111 in a clockwise direction, to impart a tension to the inner linear member 13 and, while maintaining that tension, to tighten the second tightening flange 109 against the face 102 of the hollowed-out area 100 using the screws 115. That type of fixation for the linear member 13 makes it possible to easily replace the latter, in case of need, in the following manner.

In the first stage of replacing each member 13, the flanges 106 and 109 are disassembled and the ends of the linear member 13 are removed from the cylindrical pin or peg 103. A new linear member is then attached to one end of the member that is to be replaced using a string or a piece of metal wire that is made to run through the opening in the one end of the new member and the one end of the old member. In the third step, the free end of the linear member to be replaced is then pulled until the junction between the old and the new member appears. After that, the old linear member is separated from the new linear member and the eyes 104 and 105 of the new linear member are engaged on the cylindrical peg or pin 103 and the tightening flange 106 is tightened to secure it thereto. To finish the installation of the linear member, it is then stretched using the lever 111, and the member is then locked in the stretched or tightened condition by the flange 109. As evident from the above description of the steps for replacing the linear member, it does not require the disassembly of the introduction station and it permits a fast exchange of the linear member when necessary.

Although various minor modifications may be suggested by those versed in the art, it should be understood that I wish to embody within the scope of the patent granted hereon all such modifications as reasonably and properly come within the scope of my contribution to the art.

I claim:

1. In a device for sequential introduction of sheets into a shaping or forming machine from a pile of sheets located in a magazine that is found above a feeding table, said magazine having a front gate for holding back the sheets and the magazine being located upstream from two introduction rollers for the shaping or forming machine, said device comprising a vacuum chamber, and sequential transportation means being placed side-by-side and being vertically displaceable, first means to linearly drive said sequential transportation means along a linear direction and second means to drive said sequential transportation means along a vertical direction, the improvements comprising the sequential transportation means being formed of a linear member that passes around a return pulley located in the neighborhood of the front gate and the two introduction rollers and around a control pulley keyed to a first shaft, said linear member being attached at both of its ends to said control pulley to move therewith, an upper run of the linear member extending between the axis of the return pulley and the axis of the control pulley being supported by a series of small rollers having a non-circular periphery being mounted on transverse shafts supported at their ends in two lateral plates, the linear member being placed under tension between said return pulley and control pulley, said first means comprising a second shaft being imparted with a pendular rotating motion produced by a connecting rod, crankshaft assembly, with the crankshaft being mounted on a third rotating shaft, means for rotating the third shaft in a continuous direction, kinematic means for transferring the movement of the second shaft to said first shaft, said sequential transportation means including a train of gears for transmitting the continuous rotation of the third shaft to each of the small rollers so as to rotate the small rollers with a high point of their periphery engaging an upper run of the linear member to shift the linear member from a retracted position to a position to engage a bottom sheet of said stack, said first and second means being interconnected so that forward displacement of the linear member occurs after lifting the linear member into engagement with said bottom sheet.

2. In a device according to claim 1, wherein the linear member comprises a linear strap covered with a coating that insures its adhesion to a sheet to be introduced, said linear strap being arranged so that each one of its ends has an eye, the shape of which is approximately circular.

3. In a device according to claim 1, wherein the linear member is constituted by a rubberized strap, the ends of which are not bound together, said rubberized strap having ends provided with approximately circular eyes.

4. In a device according to claim 1, wherein the kinematic means is formed by a notched belt extending between a gear on the first shaft and a gear on a second shaft.

5. In a device according to claim 1, wherein the kinematic means is formed by a gear train including a gear on each of the first and second shafts and at least one intermediate gear.

6. In a device according to claim 1, wherein the second means to drive the sequential transportation means vertically constitutes a gear train that transmits the continuous rotation of the third shaft to the shafts of each of the small rollers, said gear train having a transmission having a ratio of 1:1 and a ratio of 1:2.

7. In a device according to claim 1, wherein each of the small rollers is a cam having a single high spot, said cams being continually rotated in a single direction.

8. In a device according to claim 1, wherein each of the rollers is a cam having a single high spot, said first means and said second means being angularly synchronized relative to each other so that the high spots of each of the cams comes in contact with the upper run of the linear member before advancing the upper run in a forward direction, and said projections of the cams move out of contact with the upper run prior to the beginning of the movement of the upper run in the opposite direction.

9. In a device according to claim 1, wherein the control pulley has a hollowed-out area providing first and second faces, said means for fixation of the ends of the linear member on said control pulley including a cylindrical projection extending from one of said first and second faces, said linear member having approximately circular eyelets located at each end received on said cylindrical projection, a first flange centered on said cylindrical projection to clamp the ends thereon, a second flange being secured to the other of the first and second faces to clamp a portion of the linear member against said other face after the linear member has been placed under the desired amount of tension.

10. In a device according to claim 1, which includes means for displacing the lateral plates comprising two eccentric spindles, said lateral plates being mounted on said eccentric spindles, a control lever connected to each of said spindles and being interconnected by a coupling rod so that rotation of said levers rotates the eccentric spindles between two positions to shift the lateral plates and the shafts mounted thereon in a vertical direction.

11. In a device according to claim 1, wherein the vacuum chamber is formed by a plurality of vacuum boxes placed on each side of the sequential transportation means, said boxes being connected to a common source of vacuum and being provided with operation means to enable isolating each box from said source.

12. In a device according to claim 11, wherein the operation means comprises a slide-type valve.

13. In a device according to claim 9, wherein the control pulley has a bore adjacent the cut-out portion for receiving a pin of a tool for applying tension to the linear member prior to securing the second flange, said tool including a lever having a first pin for receiving in the bore and a second pin for engaging said linear member as the lever is rotated around the first pin.

14. In a device according to claim 10, which includes a pneumatic piston for actuating one of the levers.

* * * * *